United States Patent [19]

Lauterbach et al.

[11] Patent Number: 5,022,832

[45] Date of Patent: Jun. 11, 1991

[54] RING VALVE TYPE AIR COMPRESSOR

[75] Inventors: Jerre F. Lauterbach; Nathan Ritchie, both of Columbus; Richard F. Miller, North Vernon, all of Ind.

[73] Assignee: Holset Engineering Company, Columbus, Ind.

[21] Appl. No.: 278,225

[22] Filed: Nov. 30, 1988

[51] Int. Cl.[5] ..... F04B 21/02

[52] U.S. Cl. ..... 417/571; 137/516.15

[58] Field of Search ..... 417/563, 564, 569, 571, 417/565, 279, 454; 137/576.15, 543.19

[56] References Cited

U.S. PATENT DOCUMENTS 2,556,623 6/1951 Lipkau ..... 417/295

4,045,009 8/1977 Pees ..... 137/512.15

FOREIGN PATENT DOCUMENTS 1809954 5/1970 Fed. Rep. of Germany ..... 417/564

*Primary Examiner*—Leonard E. Smith

*Assistant Examiner*—D. W. Scheuermann

*Attorney, Agent, or Firm*—Dykema Gossett

[57] ABSTRACT

There is disclosed a valve assembly and a reciprocating type fluid pump having a piston cylinder and a cylinder head together which define a fluid chamber. A first ring valve having a seal surface on one side is disposed within the fluid chamber adjacent to the cylinder head to close at least one fluid intake passage. A bias means is provided for urging the first ring valve against the seat on the head by abutting the ring valve on the side opposite from the seal surface, and the bias means includes a peripheral region which is connected to the fluid pump and retains the first ring valve between the cylinder head and the bias means.

14 Claims, 5 Drawing Sheets

RING VALVE TYPE AIR COMPRESSOR

BACKGROUND OF THE INVENTION

I. Field of the Invention

The present invention relates generally to valves for controlling fluid flow that operate to permit and disrupt fluid flow automatically, and particularly to ring-type valve structures, including biasing means, used as air inlet valves and exhaust valves in high pressure gas compressors and fluid pumps.

II. Description of the Prior Art

Ring-type valves per se are generally well known in the prior art, and have a wide acceptance in use for air compressors and pumps. Basically, these ring-type valves are opened and closed by pressure differential on opposite sides of the ring valve. It is also heretofore known to include biasinq of spring devices along with such ring valves in order to accurately control valve movement upon a pressure differential which is above the spring force of the spring selected in each case. In this way, the valve is opened or closed only upon reaching a predetermined pressure differential dependent on the spring properties of the spring chosen, and the mass of the valve, wherein the valve action can be predicted.

Examples of ring valves and spring devices are shown by Herzmark, U.S. Pat. No. 2,382,716, issued Aug. 14, 1915; Peters, U.S. Pat. No. 1,222,321, issued April 10, 1917; and Garland, U.S. Pat. No. 3,786,834, issued Jan. 22, 1974.

The Herzmark reference is directed to an air compressor which utilizes ring valves to control air flow between low stage and high stage air compression cylinders. Herzmark also discloses the use of spring washers that are freely supported to bias the ring valves in a desired position. This type of spring washer and ring valve requires additional supporting structure to retain the spring washer that decreases the efficiency of the air compressor by lowering the compression volume of each cylinder at the end of the suction stroke, and increases the cost, weight and complexity of the valve assembly.

The above-mentioned patents to Peters and Garland simply illustrate the conventional use of ring valves and spring devices arranged on air compressors concentrically. These references are likewise deficient in that additional support structure is needed for the valves and springs.

SUMMARY OF THE PRESENT INVENTION

The solution to the problems present in the prior are achieved by a valve assembly and reciprocating type fluid pump having a piston cylinder and a cylinder head together which define a fluid chamber. A first ring valve having a seal surface on one side is disposed within the fluid chamber adjacent to the cylinder head to close at least one fluid intake passage. A bias means is provided for urging the first ring valve against a seat on the head by abutting the ring valve on a side opposite from the seal surface, and the bias means includes a peripheral region which is connected to the fluid pump and retains the first ring valve between the cylinder head and the bias means.

Thus, it is a primary object of the present invention to provide a fluid pump device such as an air compressor that has an increased volumetric efficiency while at the same time reducing costs, weight and complexity.

It is another object of the present invention to provide a valve assembly for an air compressor including a ring valve and a spring element, wherein the spring element includes a peripheral region which is to be connected to the compressor within the compression chamber thereof for retaining the ring valve adjacent to the cylinder head of the compressor.

It is yet another object to provide the spring element with a peripheral region to be secured between the piston cylinder and the cylinder head of an air compressor, whereas the peripheral region serves as a head gasket between the aforementioned points to seal the compression chamber of the compressor. By making the spring element and the head gasket one piece instead of plural pieces, the amount of volume of the compression chamber at top dead center of the piston, at the maximum compression stroke, is decreased. This, in effect, minimizes the clearance volume between the top of the piston and the cylinder head to therefor raise the efficiency of the compressor.

It is yet another object of the present invention to decrease the manufacturing costs of a valve assembly and an associated air compressor, by providing a simple valve device which does not rely on pressure differential to operate the valve, wherein a spring element closes the valve immediately at the bottom dead center of the suction stroke.

Further objects and advantages of the present invention will be apparent from the following description and appended claims, reference being made to the accompanying drawings forming a part of the specification, wherein like reference characters designate corresponding parts in the several views.

It is to be understood that the present invention is not limited to the details of construction and arrangement of parts illustrated in the accompanying drawings, since the invention is capable of other embodiments, and of being practiced or carried out in various ways within the scope of the claims. Also it is to be understood that the phraseology and terminology used herein is for the purpose of description, and not of limitation.

DETAILED DESCRIPTION OF THE PREFERRED EMBODIMENT OF THE PRESENT INVENTION

Figure 1:
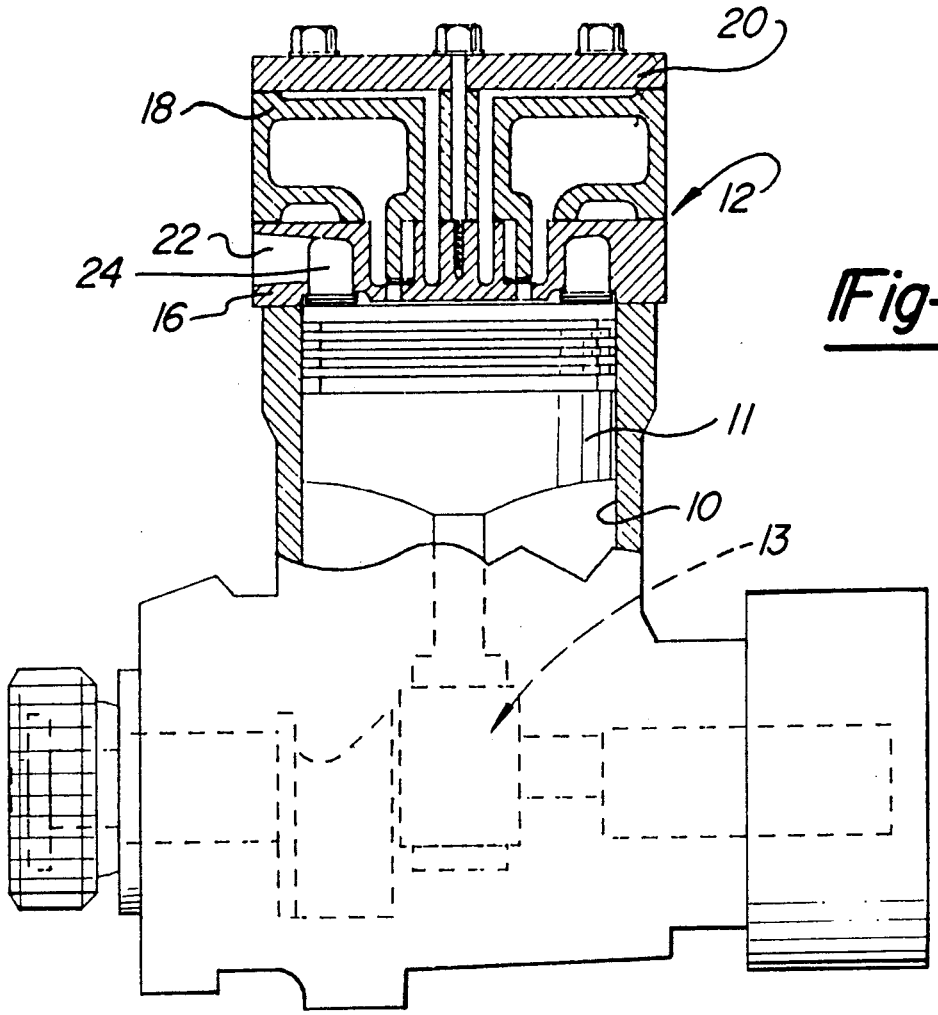
FIG. 1 is an elevational view partially cut away of a ring valve type air compressor embodying the present invention.
Figure 2:
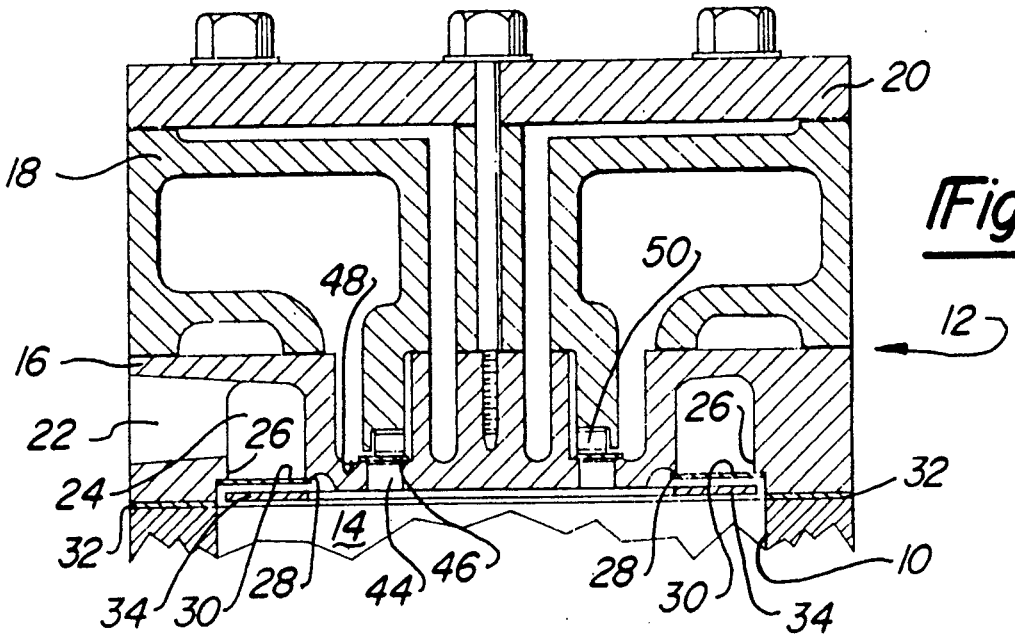
FIG. 2 is an enlarged view of the cylinder head area of the ring valve type air compressor shown in FIG. 1.

With reference to the drawings, and in particular to FIGS. 1 and 2, illustrated is a valve assembly and a portion of an air compressor or fluid pump. The remaining description will refer to the unit as a compressor and valve assembly with the understanding that the valve assembly can be used on any similar type fluid pump.

Shown is a reciprocating type compressor including a piston cylinder 10 and a cylinder head 12. Within the piston cylinder 10 is a piston 11 driven by a conventional crankshaft 13 or other suitable means. The piston, the piston cylinder bore and the head define a fluid chamber, more particularly a gas compression chamber 14, the volume of which is varied by movement of the piston.

Air or other gas enters into the gas compression chamber by way of the cylinder head 12, which is divided into a plurality of elements in the preferred form as in FIG. 2. However, it is only necessary that there be a single element to provide both intake and exhaust as will be apparent from the description below. The head 12 of the FIG. 1 embodiment comprises a two part assembly with a plate 16 and a body 18 along with a cover plate 20. Together, these elements define the air flow passages for air intake and exhaust.

Figure 5:
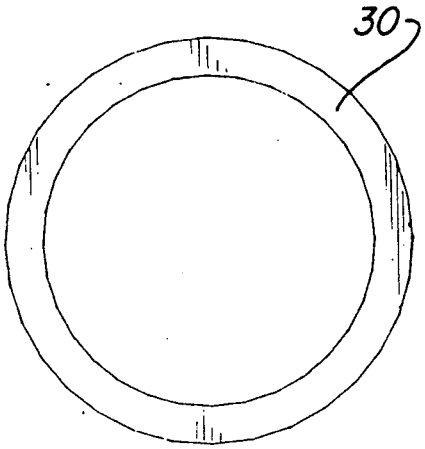
FIG. 5 is a top plan view of the ring valve used with the present invention.

At least one air intake 22 is provided in plate 16 which opens into a gallery 24 also formed in plate 16 and which provides a circular channel on the bottom face of plate 16 for better distribution of intake air into the gas compression chamber 14 by way of an intake valve, as hereinafter described. The gallery 24 is further defined on the outer face of the plate 16 by an outer circular ridge 26 and an inner circular ridge 28. The outer and inner ridges together serve as a valve seat for the intake valve comprised of a ring valve 30. The ring valve 30 includes a seal surface on one side thereof to contact the valve seat and thereby close off the intake air from the gas compression chamber 14. Ring valve 30 is illustrated in FIG. 5 and is dimensioned so as to completely cover the gallery 24 as defined between the inner and outer ridges 28 and 26 respectively. The ring valve and gallery together present a simple design with a high flow area.

Figure 4:
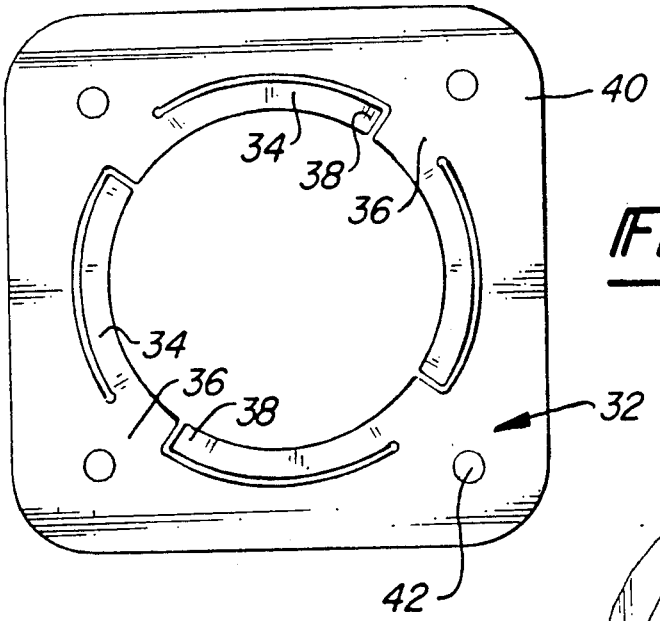
FIG. 4 is a plan view of a valve spring and gasket embodying the construction of the present invention.
Figure 6:
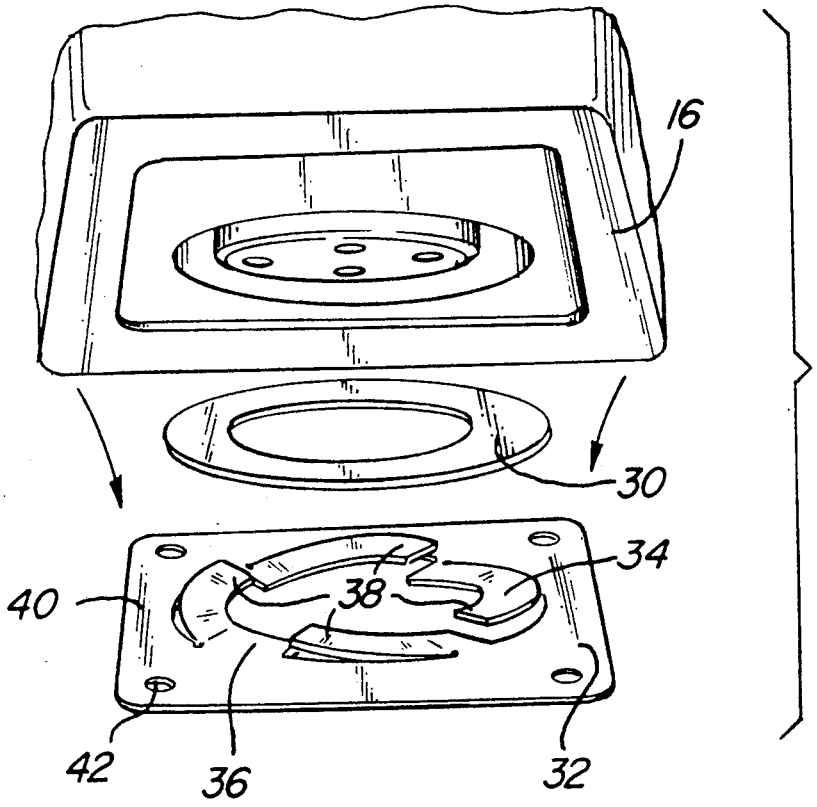
FIG. 6 is a perspective view showing how the valve spring and ring valve of the present invention are installed in the cylinder head of FIG. 2.

Disposed adjacent to the ring valve 30 is a spring element 32 to bias the ring valve 30 against its seat defined by ridges 26 and 28. The spring element 32, seen most clearly in FIGS. 4 and 6, comprises a substantially flat plate-like member of rectangular configuration with a circular opening therein. Within the circular opening are four spring arms 34 which are connected to the spring element 32 at 36. Preferably, the spring arms 34 can be provided on the spring element wherein four are used in the preferred embodiment. The spring arms 34 extend from connection points 36 toward distal ends thereof at 38, and the spring arms also extend outward from the plane of the spring element 32 in increasing distance toward the distal ends. As shown in FIG. 6, the spring arms 34 extend out of the plane of the page toward the viewer with the distal ends 38 of each spring arm out substantially the same distance.

The spring element 34 further comprises a substantially flat peripheral region 40 completely surrounding the spring element 32. This peripheral region 40 serves the dual purpose of connecting the spring element 32 to the air compressor to retain the ring valve 30 between the head and the spring element, and also to serve as a head gasket between the head 12 and the piston cylinder 10 to seal the gas compression chamber 14 from outside air. The spring element 32 along with spring arms 34 and the peripheral region 40 obtains a very simple construction which forces the ring valve 32 in operative position as well as sealing the gas compression chamber. Holes 42 are also provided through the peripheral region to facililtate bolts (not shown) for securing the head to the piston cylinder.

Figure 3:
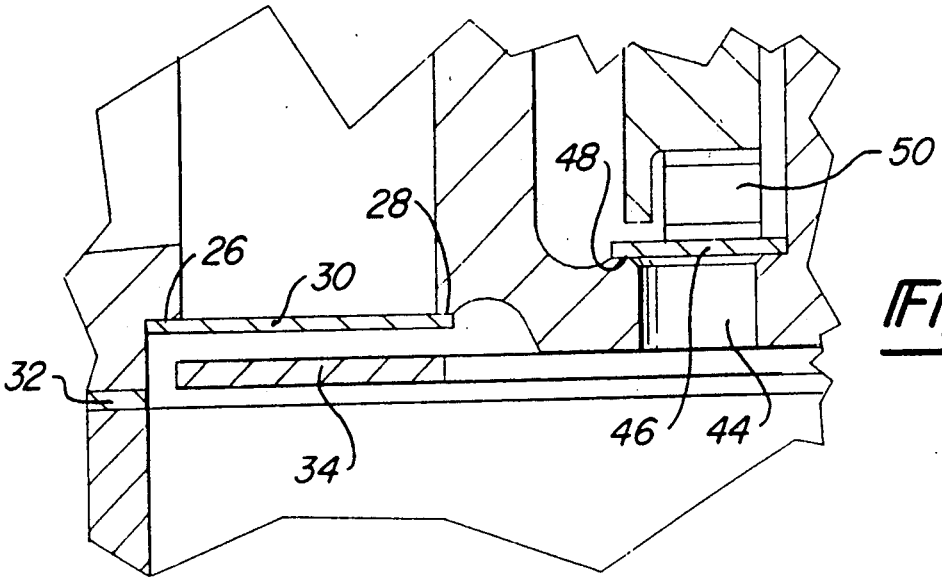
FIG. 3 is a further enlargement of the valve seat area of the cylinder head shown in FIG. 2.

Returning to FIGS. 2 and 3, there is an exhaust passage 44 through plate 16 of head 12 which is closed off by a second ring valve 46. The ring valve 46 is provided on the opposite side of the head plate 16 and contacts a seat 48 on the plate 16. The second valve 46 is biased toward the seat in a closed position by a spring means 50. The spring means 50 can be any conventional spring such as a single spiral spring, a plurality of small spiral springs, a leaf spring or springs, or a spring device similar to that shown in FIG. 4 without the gasket region. Likewise, the ring valve 46 is similar to that shown in FIG. 3, but is dimensioned to seat entirely with seat 48 and seal the exhaust passages from the gas compression chamber 14.

The operation of the valve assembly and air compressor is described as follows, starting at the point in a reciprocating compressor wherein the piston 11 is at top dead center. As the piston is moved away from the head, suction is created in the gas compression chamber 14 thus opening ring valve 30 against the bias of spring arms 34. Air thus enters the compression chamber by way of intake 22, gallery 24 and ring valve 30. When the piston reaches bottom dead center, the bias of the spring arms 34 effectively closes off the intake 22 and seals the compression chamber from the intake. The present invention thus operates to close off the intake air immediately at the bottom dead center of the suction stroke without having to rely on pressure differential to operate the ring valve. Thereafter, during the compression stroke or the piston, the intake ring valve 30 remains closed and the pressure within the compression chamber opens the exhaust ring valve 46 against the bias of spring means 50. By making the spring element and the head gasket of a single piece instead of plural pieces, the amount of volume of the compression chamber at top dead center of the piston, at the maximum compression stroke is decreased. This, in effect, minimizes the clearance volume between the top of the piston and the cylinder head to therefor raise the efficiency of the compressor.

Figure 7:
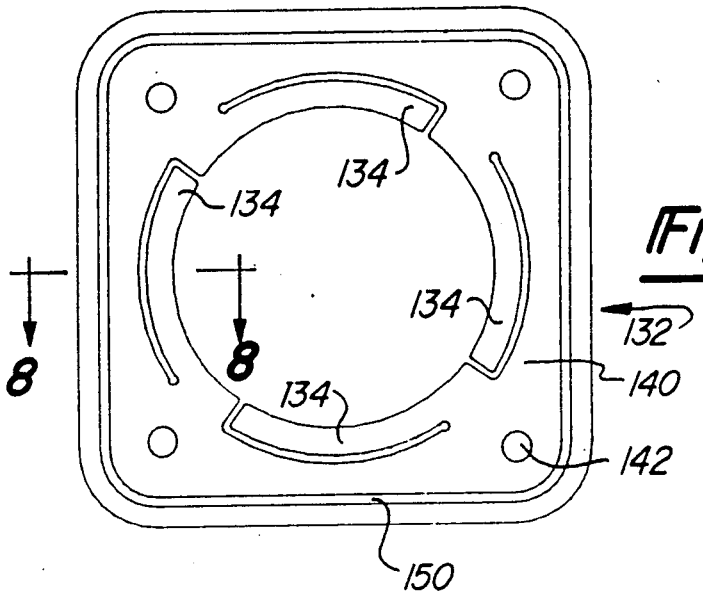
FIG. 7 is a modification of the valve spring shown in FIG. 4.
Figure 8:
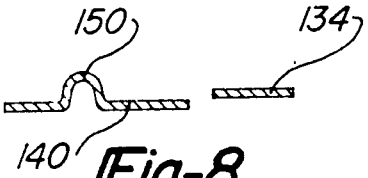
FIG. 8 is a sectional view taken in the direction of the arrows along the section line 8—8 of FIG. 7.

A further embodiment of a spring element is shown in FIGS. 7 and 8 at 132. This embodiment is basically the same as the spring element 32 including spring arms 134 and mounting holes 142 with an additional feature to improve the sealing capability of the gasket portion at the peripheral region 140. For this purpose, a crimp 150 is provided in the peripheral region 140 to extend along the peripheral region. Although it is shown that the crimp 150 extends entirely along the peripheral region, it is also possible to provide the crimps at only selected regions where increased sealability is desired. FIG. 8 simply shows a cross section along line 8—8 of FIG. 7 with the crimp 150 extending above the substantially flat plane of the peripheral region 140. The crimp 150 is positioned such that when the peripheral region is used as a head gasket between the piston cylinder and head, the crimp is subjected to the force applied by the head bolts and is compressed between the piston cylinder and the head, thereby increasing the seal of the gasket. It is also contemplated to use a bead of sealant along with the gasket to increase the seal of either the gasket with or without the crimp. Any type conventional sealant such as RTV can be used.

Figure 9:
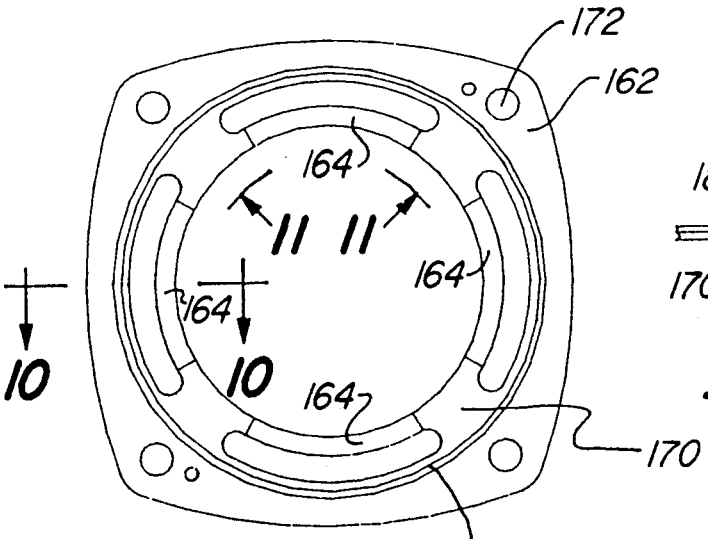
FIG. 9 is a top plan view of a modification of the valve spring shown in FIG. 7.
Figure 11:
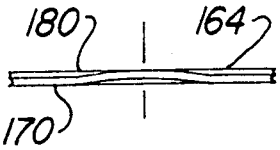
FIG. 11 is an elevational view taken in the direction of the arrows along the view line 11—11 shown in FIG. 9
Figure 10:
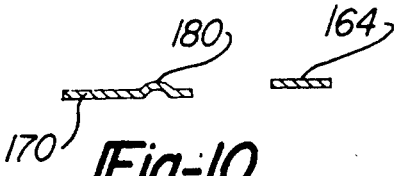
FIG. 10 is a sectional view taken in the direction of the arrows along the section line 10—10 of FIG. 9.

A still further embodiment of a spring element is shown in FIGS. 9–11 at 162. This element is still basically the same as the spring element 32, but including integral spring arms 164 and mounting holes 172 with an additional feature to improve the sealing capacity of the gasket portion, as in the embodiment shown in FIG. 7, at the peripheral region 170. For this purpose, a crimp 180 is provided in the peripheral region 170 to extend along the peripheral region. Although it is shown that the crimp 180 extends entirely along the peripheral region, as before, it is also possible to provide the crimps at only selected regions where increased sealability is desired. FIG. 10 simply shows a cross-section along line 10—10 of FIG. 9, with the crimp 180 extending above the substantially flat plane of the peripheral region 170. The crimp 180 is positioned such that when the peripheral region is used as a head gasket between the piston cylinder and head, the crimp is subjected to the force applied by the head bolts, and is compressed between the piston cylinder and the head, thereby increasing the seal of the gasket, as with the embodiment shown in FIG. 7. It is again contemplated to use a bead of sealant along with the gasket to increase the seal of either the gasket with or without the crimp. As before, any type of conventional sealant such as RTV can be used.

Further in regard to plate 16 of the head 12, a high silicon aluminum alloy with more than 11 per cent silicon is preferably used to form the plate 16. It has been found that such a high silicon plate with the valve seats 26, 28 and 48 formed thereon has an increased hardness and increased wear resistance. Preferably, the plate is die cast with an alloy of approximately 18% silicon.

The valve assembly of the present invention is applicable to air compressors of any size that use a reciprocating motion to compress air, as well as to the compression of any other gases, such as refrigerant compressors. It is also within the scope of the present invention to use such a valve assembly on other types of fluids other than gases which may, or may not, be compressible, such as for liquid pumps.

Figure 12:
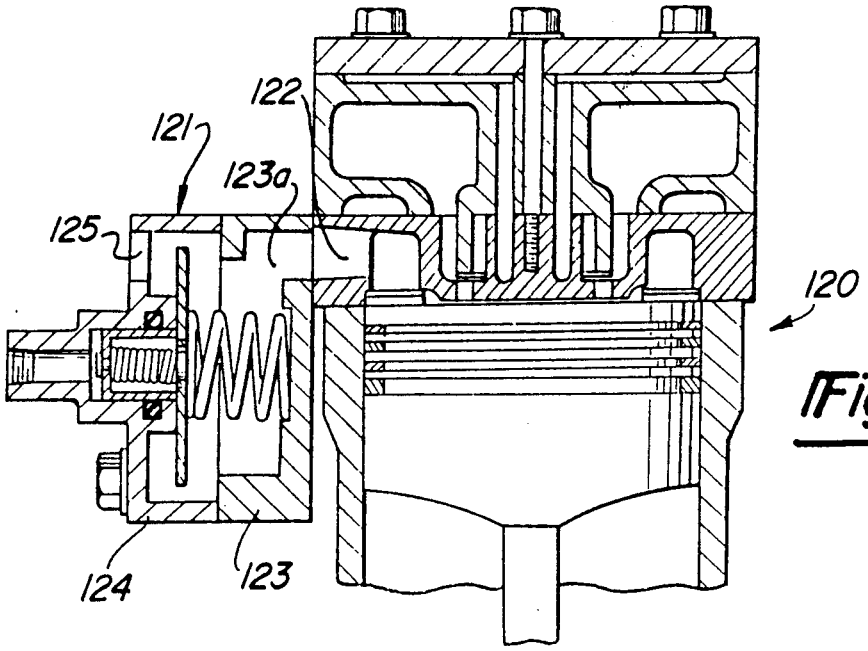
Figure 13:
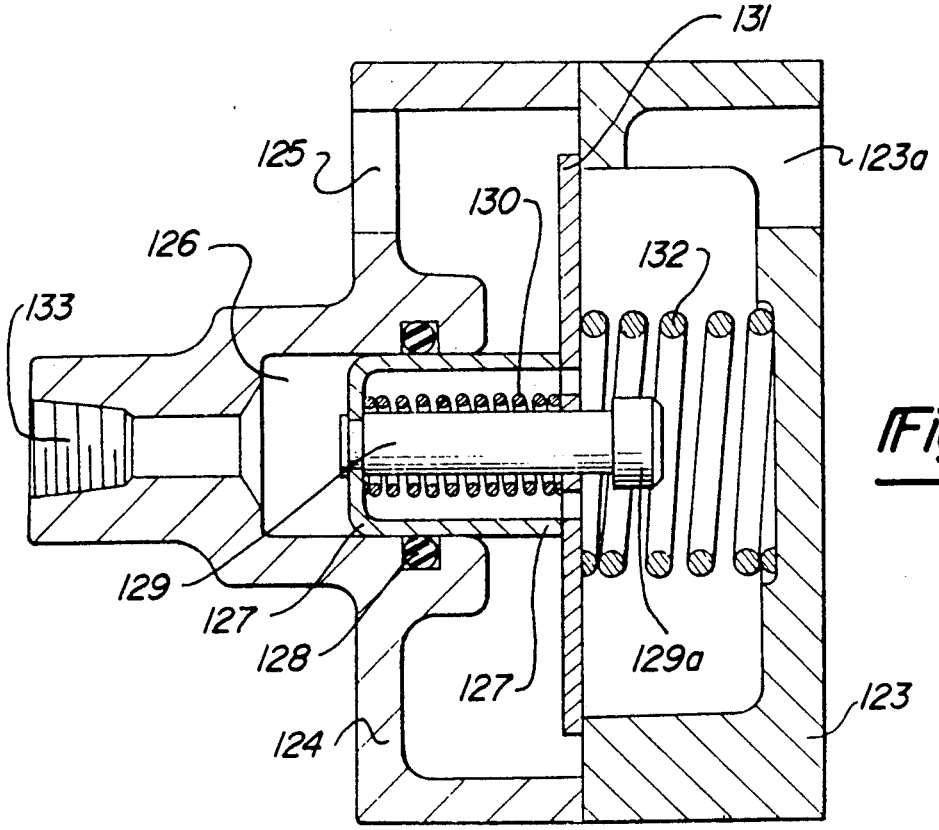

As can be seen by referring to FIGS. 12 and 13, our improved compressor can accept an external loading unloading device 121 to enable it to be used in compressor unloading systems preferably of the type disclosed in our co-pending United States Letters Patent application 07/278,17D entitled "Air Compressor Unloader System" filed on even date herewith and under common ownership with the present application. As can be seen, there is provided an air manifold 123 adapted to fit over and enclose the intake 122 of the ring valve type air compressor 120. A valve body 124 having an inlet 125 is mounted to the air manifold 123 to completely enclose the internal cavity 123*a* provided in said manifold. A cylinder 126 is formed in the valve body 124 in which is sealingly but slidably fitted a piston 127 having a piston rod 129 fixedly mounted thereto. A valve 131 is retained on the piston rod between the valve unloader spring 130 and the enlarged end 129*a* of said piston rod. As the piston 127 reciprocates in the cylinder 126, the valve 131, will also reciprocate opening and closing the internal cavity 123 of the air manifold, and therefore blocking and unblocking the fluid communication between the inlet 122 of the air compressor and the atmosphere. To assist the movement of the valve 131, valve spring 132 is interposed between the valve 131 and the manifold 123.

We claim:

1. A valve assembly and reciprocating fluid pump having a piston cylinder and a cylinder head secured to said piston cylinder defining a fluid chamber, said valve assembly comprising:

a) a first ring valve with a seal surface on one side thereof disposed adjacent to said cylinder head to selectively engage a seat means on said cylinder head and close at least one fluid passage through said cylinder head; and b) a bias means for urging said first ring valve against said seat means on said cylinder head by abutting said first ring valve on a side opposite from said seal surface;

wherein said bias means includes a peripheral region connected to said fluid pump, wherein said peripheral region of said bias means is connected to said fluid pump between opposing faces of said piston cylinder and said cylinder head and serves as a gasket for said fluid chamber, and said bias means retains said first ring valve between said cylinder head and said bias means.

2. The valve assembly of claim 1, wherein said peripheral region and said opposing faces of said piston cylinder and said cylinder head are substantially flat.

3. The valve assembly of claim 1, wherein said peripheral portion includes a crimp along at least a partial distance thereof to increase the seal of said gasket.

4. The valve assembly of claim 1, further comprising a circular gallery formed on said cylinder head which is defined between an inner and an outer circular ridge, and said inner and outer ridges provide said seat means on said cylinder head;

whereby said gallery improves fluid flow through said valve assembly by distributing the fluid flow along the seat means to be opened and closed by said first ring valve.

5. The valve assembly of claim 1, wherein said bias means has a plurality of spring arms for abutting and urging said first ring valve against said seat means, and said spring arms are connected to an internal edge of said peripheral region.

6. The valve assembly of claim 5, wherein said spring arms are formed integrally with said peripheral region, and said spring arms extend away from the plane of said peripheral region toward said cylinder head to distal ends which abut said ring valve.

7. The valve assembly of claim 1, wherein said fluid pump is a gas compressor and said fluid chamber is a compression chamber.

8. The valve assembly of claim 1, wherein said cylinder head and seat means are composed of a high silicon aluminum alloy with more than 11 per cent silicon for increased wear resistance.

9. The valve assembly of claim 1, further comprising a second ring valve disposed coaxially with said first ring valve and adjacent to said cylinder head on the side opposite to said fluid chamber for selectively closing an exhaust passage provided through said cylinder head, and a second bias means for urging said second ring valve to a closed position with respect to said exhaust passage.

10. A ring valve reciprocating type fluid pump having a piston cylinder and a cylinder head with an intake and an exhaust passage therethrough secured to said piston cylinder defining a fluid chamber, said valve assembly comprising:

a) a first ring valve disposed adjacent to said cylinder head on the fluid chamber side thereof for selectively closing said intake passage:

b) a first bias means within said fluid chamber for urging said first ring valve toward a closed position:

c) a second ring valve disposed coaxially with said first ring valve and adjacent to said cylinder head on the side opposite to said fluid chamber for selectively closing said exhaust passage:

d) a second bias mans for urging said second ring valve toward a closed position:

e) wherein said first bias means includes a peripheral region that is connected to said fluid pump between said cylinder head and said piston cylinder and serves as a gasket for sealing the fluid chamber, and said first bias means is connected to said fluid pump so as to retain said first ring valve between said cylinder head and said first bias means, and said first ring valve and said first bias means are directly exposed to said fluid chamber.

11. The fluid pump defined in claim 10, wherein said fluid pump is a gas compressor and said fluid chamber is a compression chamber.

12. The fluid pump defined in claim 10, and including an external unloading device for said fluid pump.

13. The device defined in claim 12, wherein said external unloading valve includes:

a) a manifold to be sealingly mounted over the intake of said fluid pump and having an internal cavity communicating with the intake of said pump; and b) a valve body including valve means selectively operable to open and close said internal cavity of said air manifold.

14. The device defined in claim 13 wherein said valve body includes:

a) an internal passage communicating with said internal cavity of said manifold;

b) a valve member disposed in said internal passage for movement between an open and closed position and disposed to block said internal cavity of said air manifold when in said closed position;

c) a cylinder formed in said valve body ;

d) a piston slidably and sealingly mounted in said cylinder;

e) a piston rod connecting said cylinder and said valve;

f) an unloader spring interposed between said piston and said valve:

g) a second spring means interposed between said manifold and said valve; and h) an unloader port in communication with said cylinder.

* * * * *